US005434559A

United States Patent [19]

Smiley et al.

[11] Patent Number: 5,434,559

[45] Date of Patent: Jul. 18, 1995

[54] ANTI-THEFT ALARM AND METHOD FOR PROTECTING MOVABLE ARTICLES

[76] Inventors: Al W. Smiley, 18635 Larkspur Rd., No. 8, Adelanto, Calif. 92301; Edward Faranda, II, 5203 Ashworth, Lakewood, Calif. 90717

[21] Appl. No.: 272,937

[22] Filed: Jul. 11, 1994

[51] Int. Cl.[6] ..... G08B 13/14

[52] U.S. Cl. ..... 340/571; 340/689

[58] Field of Search ..... 340/571, 689

[56] References Cited

U.S. PATENT DOCUMENTS

| | | | |
|---|---|---|---|
| 3,644,921 | 2/1972 | Duggan et al. | 340/571 |
| 4,117,468 | 9/1978 | Va'squez | 340/571 |
| 4,190,828 | 2/1980 | Wolf | 340/571 |
| 4,284,984 | 8/1981 | Scarpino, III et al. | 340/571 |
| 4,322,714 | 3/1982 | Morgan | 340/566 |
| 4,327,360 | 4/1982 | Brown | 340/571 |
| 4,385,288 | 5/1983 | Bitko | 340/571 |
| 4,458,241 | 7/1984 | Frnkenberg | 340/571 |
| 4,462,023 | 7/1984 | Nielsen et al. | 340/571 |
| 4,563,673 | 1/1986 | Fechner | 340/568 |
| 4,633,232 | 12/1986 | Nelson et al. | 340/571 |
| 4,858,137 | 8/1989 | Bradley | 340/689 |
| 5,027,105 | 6/1991 | Dailey et al. | 340/571 |
| 5,317,304 | 5/1994 | Choi | 340/571 |

*Primary Examiner*—Glen Swann

*Attorney, Agent, or Firm*—Timothy T. Tyson; Freilich, Hornbaker & Rosen

[57] ABSTRACT

An anti-theft alarm (10) for protecting movable articles has a motion sensing means (A) that generates an actuating signal when movement of a protected article is sensed, and a transducer (D) which receives the actuating signal and emits an audible or visible alert. The alarm (10) is housed within a container (12) having adhesive (20) disposed on a portion of its exterior surface (14). The alarm (10) is attached to the protected article by pressing the adhesive (20) against the article. The alarm (10) is armed and disarmed through a disarming circuit (C) containing manually setable code generators (CG1) and (CG2) and associated logic circuitry.

17 Claims, 4 Drawing Sheets

ANTI-THEFT ALARM AND METHOD FOR PROTECTING MOVABLE ARTICLES

TECHNICAL FIELD

The present invention pertains to anti-theft alarms, and more particularly to anti-theft alarms that can be attached to movable articles. When attached to the protected article, and armed, the alarm emits an audible sound or visual indication if the protected article is moved.

BACKGROUND ART

Anti-theft alarms for protecting movable articles have been known in the art for many years. Each of these previous alarms utilizes some form of movement sensor cooperating with a audible or visible alarm indicator. For example U.S. Pat. No. 3,644,921 relates to a burglar alarm system having a trundle switch connected to a horn. U.S. Pat. No. 4,117,468 describes a sonorous alarm system that can be placed in briefcases and that is operated by exterior push-buttons. U.S. Pat. No. 4,190,828 comprises a movement sensitive anti-theft alarm wherein a speaker is triggered by a photosensitive transistor. U.S. Pat. No. 4,284,984 describes an attitude change alarm containing a conductive fluid which activates a horn, buzzer or light. U.S. Pat. No. 4,322,714 shows a vehicle anti-theft alarm where impacts of steel balls produce high frequency sound and vibration which are amplified and used to energize a horn or other alarm device. The alarm is clamped to the protected article, or may be held on by straps or long screws. U.S. Pat. No. 4,327,360 depicts an alarm device responsive to movement of a protected object, power source condition and alarm ground path. Mercury switches activate an alarm transducer thorough a collection of logic circuits. U.S. Pat. No. 4,385,288 is for a motion responsive alarm system that uses pendulum type switches to energize a buzzer or visual indicator. Single-pole, double-throw (DIP) switches are used to permit selective disabling of the alarm in accordance with a predetermined key combination. The device is attached to the article to be protected by interior-accessible screws. U.S. Pat. No. 4,458,241 is a device for protecting works of art. U.S. Pat. No. 4,563,673 describes an anti-theft alarm device for video cassette recorders. U.S. Pat. No. 4,633,232 is for a personal alarm device which can be used for a variety of alarm purposes.

None of the aforementioned devices provide a rapid method for attaching the alarm to a wide variety of protected articles, nor do they permit arming and disarming through manually setable internal and external code generators.

DISCLOSURE OF INVENTION

The present invention is directed to an improved anti-theft alarm and method for broadcasting movement of a protected article. The present invention is particularly useful in allowing quick, convenient, and effective attachment of the alarm to moveable articles of all size and shape configurations without the need for either conventional or specialized mounting hardware. The present invention further provides a novel method of arming and disarming the alarm through the use of manually setable internal and external code generators and associated logic circuitry.

In accordance with a preferred embodiment of the invention, the anti-theft alarm has a motion sensing means that generates an actuating signal when movement of the protected article is sensed, and a transducer which receives the actuating signal and emits an audible or visible alert.

In accordance with a preferred embodiment of the invention, the anti-theft alarm is housed within a container having adhesive disposed on a portion of its exterior surface. The alarm is attached to the protected article by pressing the adhesive against the article.

In accordance with an important aspect of the invention, a latching circuit receives the actuating signal and thereby generates a latched actuating signal which is continuously supplied to the transducer even if the motion sensing means returns to rest.

In accordance with another preferred embodiment of the invention, a disarming circuit removes the actuating and latched actuating signals from the transducer and prevents the emission of the alert.

In accordance with an important aspect of the invention, a leveling circuit having an unlevel indicator, receives the actuating signal which causes the unlevel indicator to turn on.

In accordance with an important aspect of the invention, the motion sensing means includes one or more mercury switches. In one embodiment, two mercury switches having substantially orthogonal principal axes provide motion detection in any horizontal direction.

In accordance with another important aspect of the invention, a status indicating circuit provides a first visual indication if the disarming circuit has removed the actuating and latched actuating signals from the transducer, and provides a second visual indication if the disarming circuit has not removed the actuating and latched actuating signals from the transducer.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
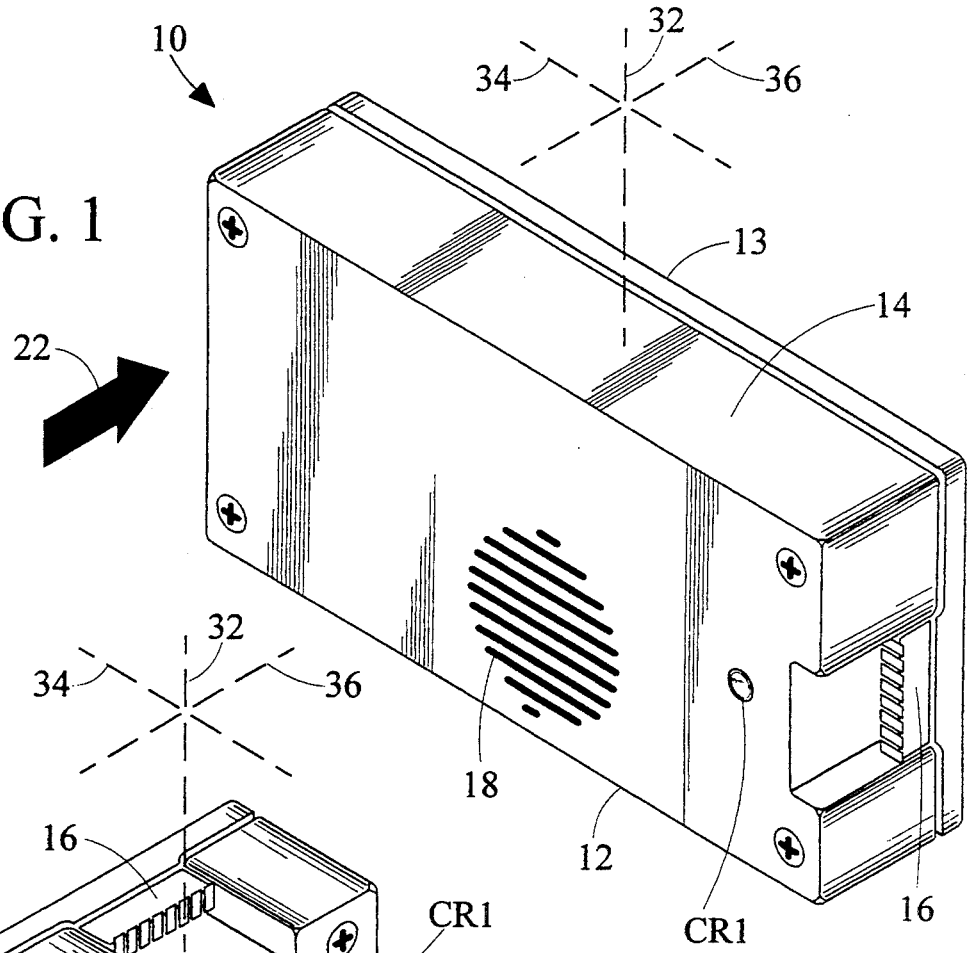
FIG. 1 is a front perspective view of the alarm in accordance with the present invention.

Referring initially to FIG. 1, there is illustrated a front perspective view of the alarm in accordance with the present invention, generally designated as 10. The alarm 10 is housed within a container 12 having an exterior surface 14. A first manually setable code generator 16 is disposed on the exterior surface 14 of the container 12. A transducer access port 18 located on the exterior surface 14 permits sensory reception of the alarm's alert signal. An adhesive 20 (FIG. 3) is disposed on a portion of the exterior surface 14 of the container 12. In the figure the adhesive 20 is disposed on the rear 13 of the container 12. The alarm 10 is attached by pressing the adhesive 20 against the protected article in direction 22. FasMount 2132 adhesive manufactured by Avery Dennison, Diamond Bar, Calif. 91765 has been found to be a useful adhesive 20. The alarm 10 is shown attached in a substantially horizontal orientation. The alarm 10 further includes a light emitting diode (LED) status indicator CR1 for providing a first visual indication if the alarm 10 is disarmed, and a second visual indication if the alarm 10 is armed.

Figure 2:
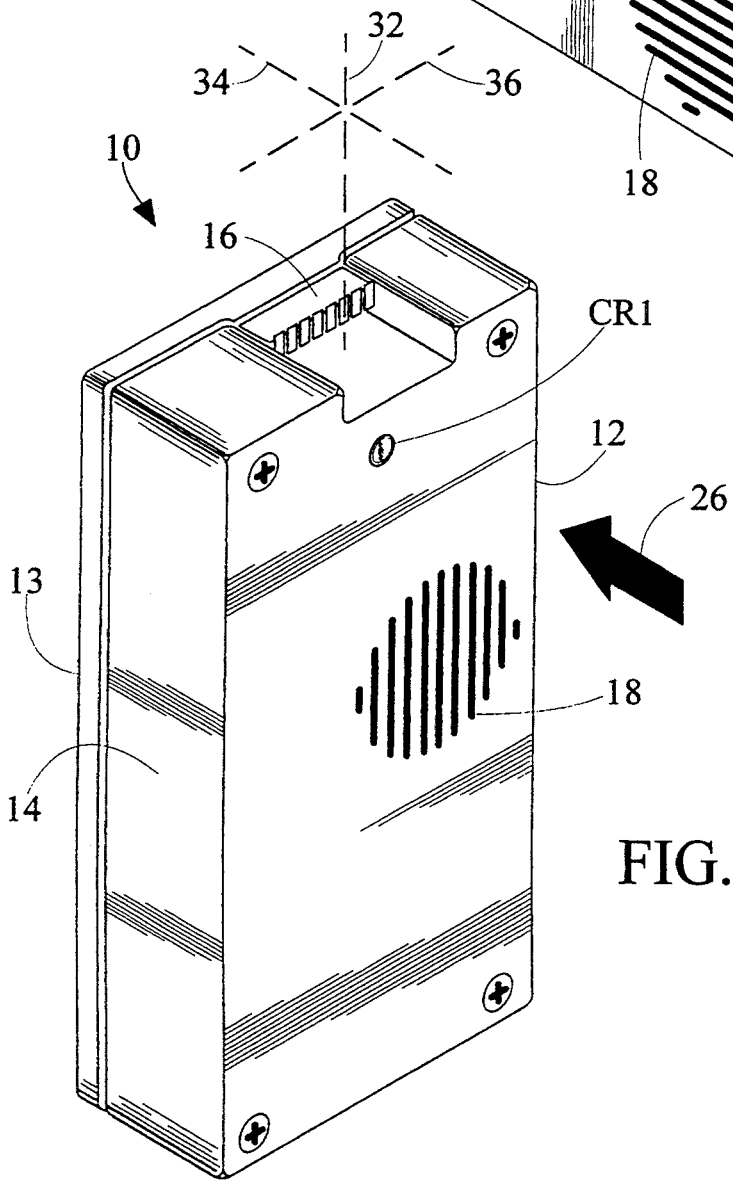
FIG. 2 is a front perspective view of the alarm oriented vertically.

FIG. 2 is a front perspective view of the alarm 10 oriented substantially vertically. The alarm 10 is attached by pressing the adhesive 20 against the protected article in direction 26. Attachment orientations other than horizontal or vertical are also possible.

Figure 3:
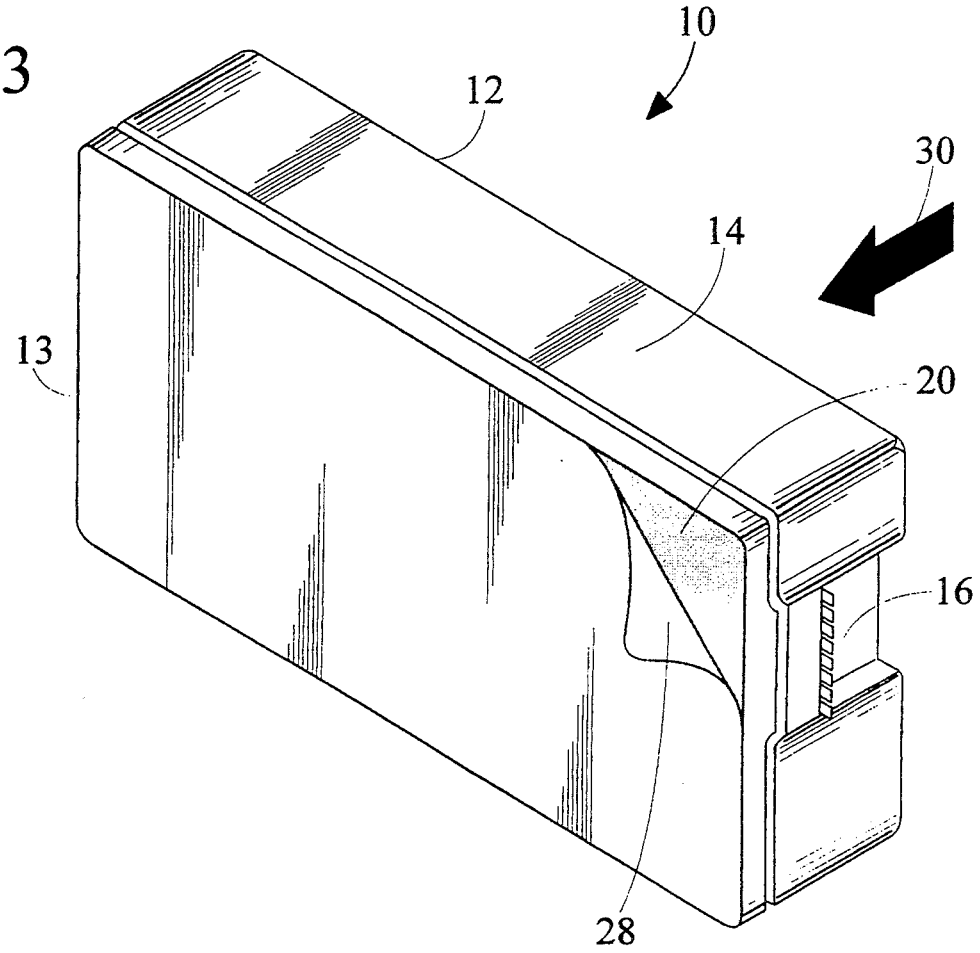
FIG. 3 is a rear perspective view of the alarm.

FIG. 3 is a rear perspective view of the alarm 10. An adhesive 20 is disposed on a portion of the exterior surface 14 of the container 12. In the figure, the adhesive 20 is disposed on the rear 13 of the container 12. The adhesive 20 has a protective peel-off covering 28 which is removed prior to attachment to the protected article. The alarm is attached by pressing the adhesive 20 against the protected article in direction 30.

Figure 4:
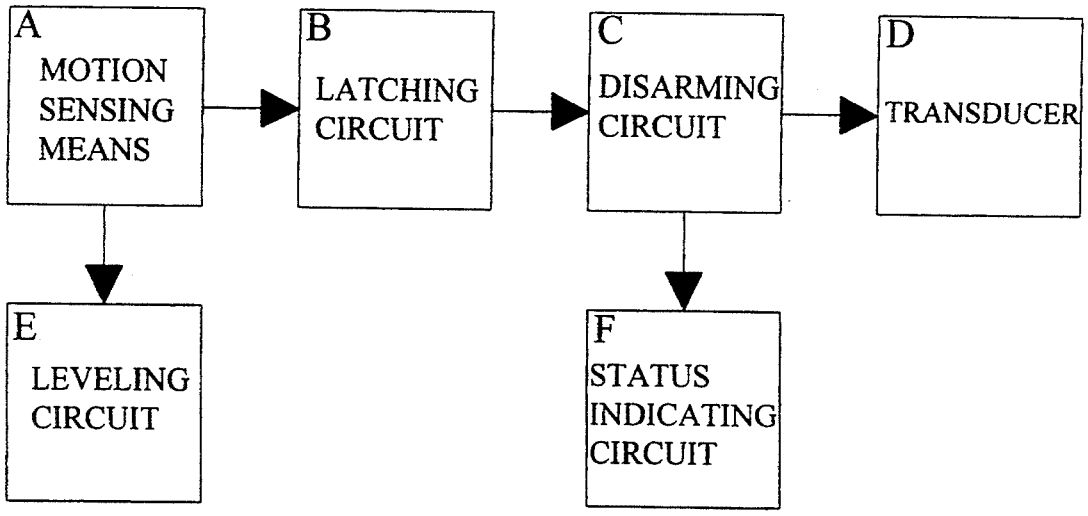
FIG. 4 is a block diagram of the alarm.

Referring to FIG. 4 there is illustrated a block diagram of the alarm 10 in accordance with the present invention. The alarm 10 is comprised of six subsections, including a motion sensing means generally designated as A, a latching circuit generally designated as B, a disarming circuit generally designated as C, a transducer generally designated as D, a leveling circuit generally designated as E, and a status indicating circuit generally designated as F. The motion sensing means A generates an actuating signal when movement of the protected article is sensed. The actuating signal causes the latching circuit B to generate a latched actuating signal. The actuating and latched actuating signals are applied to transducer D through deactivated disarming circuit C causing the transducer D to emit an alert. If disarming circuit C is activated (alarm 10 is disarmed), then the actuating and latched actuating signals are removed from the transducer D and no alert is emitted. Leveling circuit E receives actuating signal from the motion sensing means A and turns on an unlevel indicator. Status indicating circuit F has a status indicator LED that provides a first visual indication (continuous light) if the disarming circuit C is activated, and a second visual indication (blinking light) if the disarming circuit C is not activated and the alarm 10 is armed.

The motion sensing means A, latching circuit B, disarming circuit C (except first manually setable code generator 16), transducer D, leveling circuit E, and status indicating circuit F (except status indicator CR1) are all disposed within the alarm's container 12. The first manually setable code generator 16 and status indicator CR1 are disposed on the exterior surface 14 of the container 12.

Figure 5:
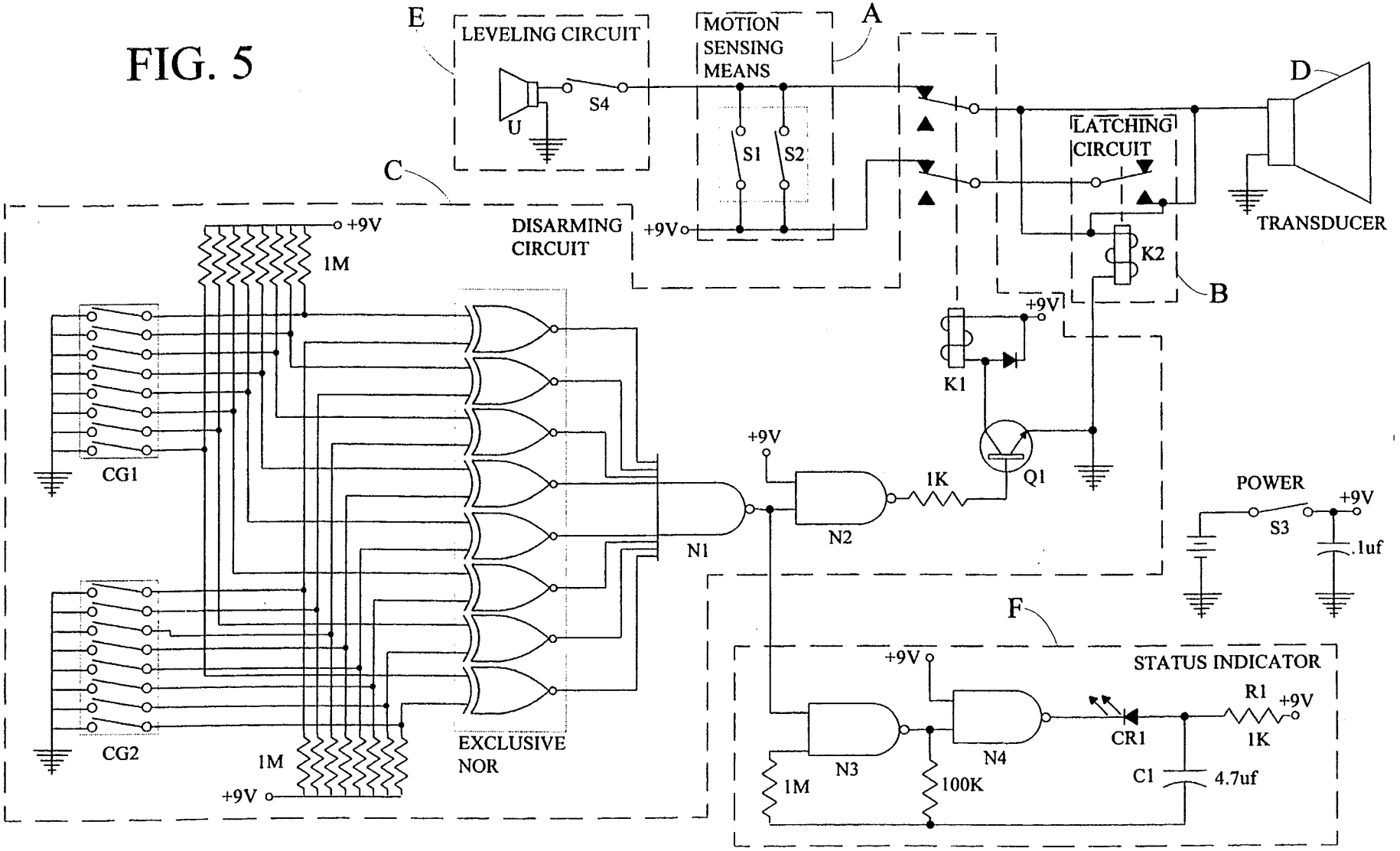
FIG. 5 is a schematic diagram of the alarm.

FIG. 5 is a schematic diagram of the alarm 10. Motion sensing means A detects movement of the protected article and generates an actuating signal through the closed contacts of switches S1 and S2. In the diagram, the actuating signal consists of +9 V that can be received from either a power supply housed within the alarm's container 12, or from an external power source. Depending upon the specific circuit components selected, other voltage levels could also be utilized. Power switch S3 applies or removes power from all circuits of the alarm 10. The actuating signal is routed thorough the de-energized contacts of disarming relay K1 and received by the transducer D thereby causing the transducer D to emit an alert. The actuating signal also energizes latching relay K2 of latching circuit B. A latched actuating signal is generated through the energized contacts of relay K2 and the de-energized contacts of disarming relay K1, the latched actuating signal is supplied to the transducer D to continue the alert even if the motion sensing means no longer senses motion and switches S1 and S2 return to their open position.

Figure 6A:
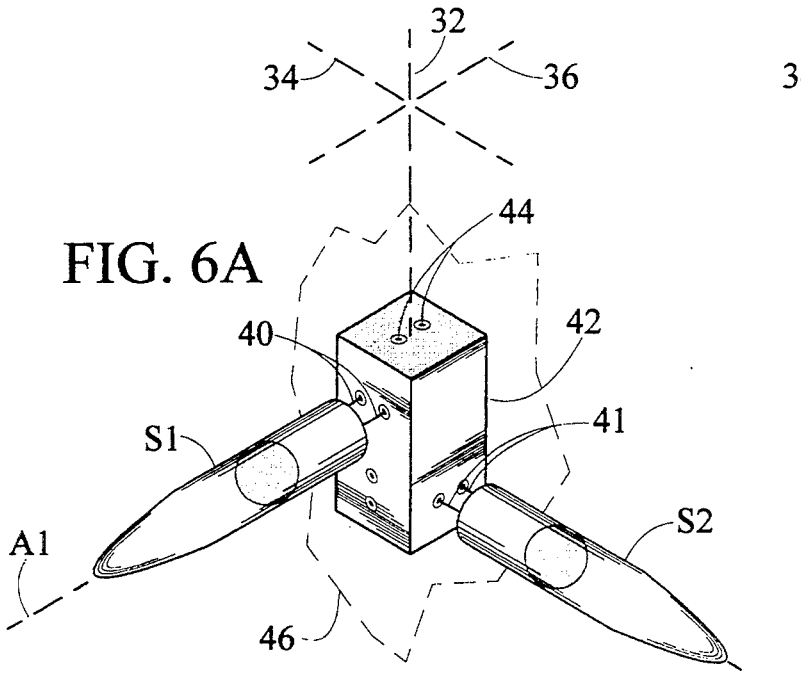
FIG. 6A is an enlarged perspective view of mercury switches S1 and S2 installed in selected receptacle positions of a jack.

In the embodiment shown the motion sensing means A consists of first and second mercury switches S1 and S2. The mercury switches are of the common glass tube type, and are available at commercial electronics suppliers such as Radio Shack TM. However, any other motion sensing device capable of producing an actuating signal such as pendulum switches, accelerometers, tilt sensors, trundle switches, or the like could also be utilized. Using two, or more, mercury switches results in two decided advantages. First should one switch fail, the other switch would maintain the alarm 10 in an operational state. Also, if the switches are oriented so that their axes of sensitivity are substantially orthogonal, then components of protected article motion in any horizontal direction would be sensed. Additionally, a novel switch mounting feature is provided which permits the first and second mercury switches to be oriented so as to accommodate either horizontal or vertical attachment of the alarm 10 to the protected article. For horizontal attachment, referring to FIG. 1 and FIG. 6A, first mercury switch S1 has a first set of electrical leads 40, and a first principal axis A1. Axis A1 is parallel to axis 36. Similarly, second mercury switch S2 has a second set of electrical leads 41, and a second principal axis A2. Axis A2 is parallel to axis 34 and substantially orthogonal to axis A1. A jack 42 is connected to the interior structure 46 of the alarm 10. The jack has a plurality of substantially orthogonally oriented electrical receptacle positions 44. The electrical receptacle positions 44 are suitable for accepting the first and second sets of electrical leads. In FIG. 6A the leads of the first and second mercury switches are installed in the indicated receptacle positions 44 so that axes A1 and A2 are orthogonal to vertical axis 32, and therefore level. This is the proper orientation for the alarm 10 as shown in FIG. 1.

Figure 6B:
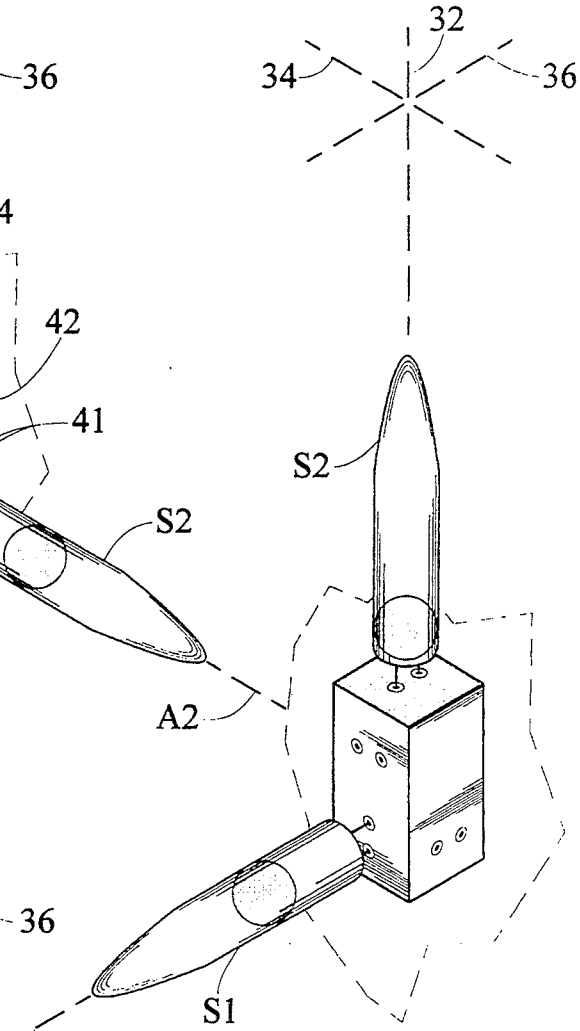
FIG. 6B is an enlarged perspective view of mercury switches S1 and S2 installed in different selected positions of the jack; and, FIG. 6C is an enlarged perspective view of mercury switches S1 and S2 after turning, oriented as in FIG. 2.

For vertical attachment of the alarm 10, the first and second mercury switches are moved to the new electrical receptacle positions 44 indicated in FIG. 6B. Axis A1 remains parallel to axis 36, but axis A2 is now parallel to vertical axis 32.

Figure 6C:
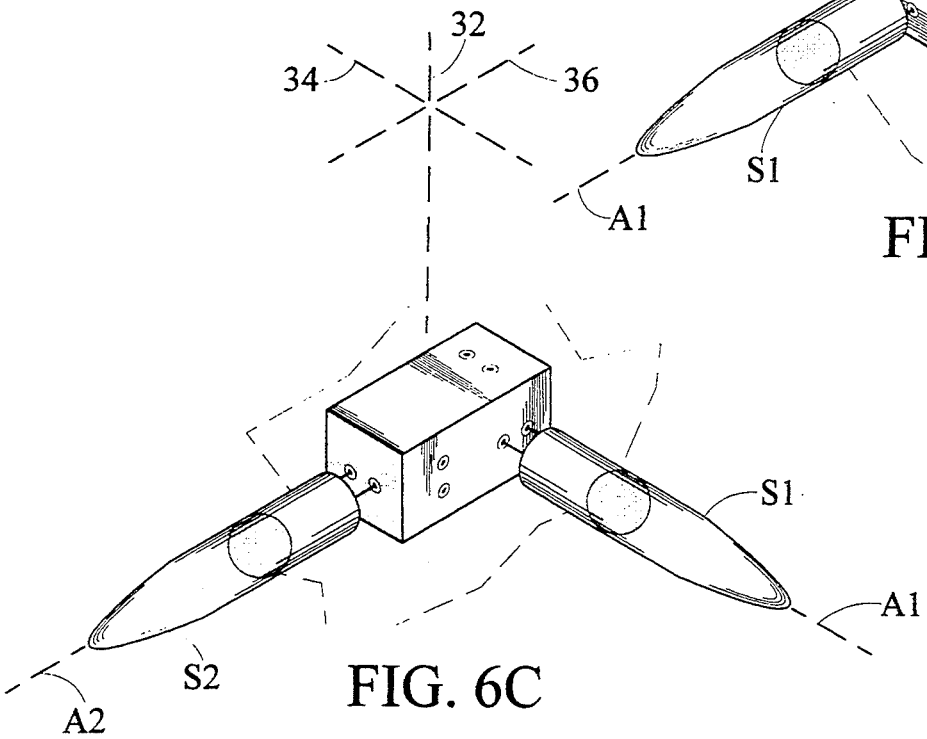

With the mercury switches installed as shown in FIG. 6B, the entire alarm is rotated substantially 90° and turned so as to appear as in FIG. 2. The corresponding position of the mercury switches is shown in FIG. 6C. The turning process results in axis A1 being parallel to axis 34, and axis A2 being parallel to axis 36. Both axes A1 and A2 are orthogonal to vertical axis 32, and therefore level.

Other methods of achieving the rotation of the mercury switches are also possible. For example, the jack 42 could be partitioned into two rotating jacks, one for the first mercury switch S1, and the other for second mercury switch S2. The rotating jacks would contain a pivoting mechanism which would permit rotation to the desired orientation. In this embodiment, attachment of the alarm 10 to the protected article could be made at any orientation angle.

In the embodiment shown transducer D consists of an audible sound producing device such as a horn, siren, buzzer, bell, speaker or the like. However, a visible device such as a continuous or flashing light could also be employed either in conjunction with or in lieu of the audible device.

When the alarm 10 is not level, leveling circuit E receives the actuating signal generated by the motion sensing means A through the closed contacts of leveling switch S4. The actuating signal turns on unlevel indicator U which, in the embodiment shown, emits a low volume audible sound indicating that the alarm 10 is not level. By manually adjusting the orientation of the alarm's container 12, the motion sensing means A is brought to level and the unlevel indicator U turns off. A visible unlevel indicator U such as a light could also be employed.

The disarming circuit C includes a first manually setable code generator CG1 which produces a first code output selected from a plurality of possible code outputs, and a second manually setable code generator CG2 which produces a second code output from a plurality of possible code outputs. In the embodiment shown the first and second code generators CG1 and CG2 consist of dual in-line package (DIP) switches containing eight switches per package, therefore giving a total of 256 possible code outputs per package. A greater or lesser number of switches per package will correspondingly increase or decrease the possible code outputs per package. Closing a particular switch produces a low level voltage, while opening the switch produces a high level voltage. A code comparator including a plurality of exclusive NOR logic circuits (74HC266), NAND gates (74HC00, 74HC30), an NPN transistor (2N2222), and a relay compares the first code output with the second code output, and if the first code output and the second code output are the same, the code comparator removes the first and second actuating signal from transducer D. That is, when, and only when, the first code output and the second code output are the same the output of each of the comparator's eight exclusive NOR logic circuits will be high level voltage (near +9 V). All eight high inputs to NAND gate N1 results in a low voltage output (near ground). The low output of NAND gate N1 causes NAND gate N2 to produce a high output, which causes NPN transistor Q1 to conduct and energize disarming relay K1, which in turn de-energizes latching relay K2, thereby removing both the actuating and latched actuating signals from transducer D.

Status indicating circuit F receives the output of NAND gate N1 and provides a first visual indication (continuous light) if the code comparator has removed the actuating and latched actuating signals from the transducer, and provides a second visual indication (blinking light) if the code comparator has not removed the actuating and latched actuating signals from transducer D. That is, when code generator CG1 and code generator CG2 produce the same output code, the output of NAND gate N1 is low which causes NAND gate N3 to produce a high output, which in turn causes NAND gate N4 to produce a low output. The low output of N4 causes status indicator light emitting diode (LED) CR1 to conduct and emit a continuous light denoting that the alarm 10 is disarmed. Conversely, when the code outputs are not the same, the output of NAND gate N1 is high which causes NAND gate N3 to produce a low output, which in turn causes NAND gate N4 to produce a high output (somewhat less than +9 V). With a high voltage applied to the cathode of CR1, capacitor C1 will charge toward +9 V through resistor R1 until the voltage on the anode of CR1 exceeds the cathode voltage causing CR1 to conduct and emit a light. Capacitor C1 then discharges through CR1, N4 and the 100K resistor thereby reducing the anode voltage of CR1 and causing CR1 to cease conducting. This charging, conducting, and discharging process repeats causing CR1 to emit a blinking light denoting that the alarm 10 is armed.

The alarm 10 is attached to the article to be protected by first manually setting the second code generator CG2 so as to produce a second code output selected from a plurality (in the shown embodiment 256) if possible code outputs. Manually setting the first code generator CG1 so as to produce a first code output that is the same as the second code output. Manually adjusting the orientation of the container 12 until the motion sensing means A is level and the unlevel indicator U turns off. Pressing the adhesive 20 against the article to be protected, and arming the alarm 10 by manually setting the first code generator CG1 so that the first code output is no longer the same as the second code output.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. An alarm for broadcasting movement of a protected article, comprising:

a motion sensing means for detecting movement of the protected article, said motion sensing means generating an actuating signal when movement is sensed;

a transducer receiving said actuating signal and thereby emitting an alert;

a container having an exterior surface, said motion sensing means and said transducer disposed within said container;

adhesive disposed on a portion of said exterior surface;

said motion sensing means further including a first mercury switch having a first principal axis and a second mercury switch having a second principal axis, said first and second principal axes being substantially orthogonal; and, said first mercury switch having a first set of electrical leads, and said second mercury switch having a second set of electrical leads, said alarm further including a jack having a plurality of substantially orthogonally oriented electrical receptacle positions, said electrical receptacle positions suitable for accepting said first and second sets of electrical leads.

2. An alarm for broadcasting movement of a protected article, comprising:

a motion sensing means for detecting movement of the protected article, said motion sensing means generating an actuating signal when movement is sensed;

a transducer receiving said actuating signal and thereby emitting an alert;

a container having an exterior surface, said motion sensing means and said transducer disposed within said container;

adhesive disposed on a portion of said exterior surface; and, a leveling circuit having an unlevel indicator, said leveling circuit receiving said actuating signal thus causing said unlevel indicator to turn on.

3. An alarm for broadcasting movement of a protected article, comprising:

a motion sensing means for detecting movement of the protected article, said motion sensing means generating an actuating signal when movement is sensed;

a transducer receiving said actuating signal and thereby emitting an alert;

a container having an exterior surface, said motion sensing means and said transducer disposed within said container;

adhesive disposed on a portion of said exterior surface;

a latching circuit, said latching circuit receiving said actuating signal and thereby generating a latched actuating signal and supplying said latched actuating signal to said transducer; and, a disarming circuit, said disarming circuit including: (1) a first manually setable code generator producing a first code output manually selected from a plurality of possible code outputs, said first code generator disposed on said exterior surface of said container; (2) a second manually setable code generator producing a second code output manually selected from a plurality of possible code outputs, said second code generator disposed within said container; and, (3) a code comparator for comparing said first code output with said second code output, said code comparator removing said actuating and latched actuating signals from said transducer when said first code output is the same as said second code output.

4. An alarm according to claim 3, wherein said first and second code generators include dual in-line package (DIP) switches, and said code comparator includes a plurality of exclusive NOR logic circuits.

5. An alarm according to claim 3, further including a status indicating circuit providing a first visual indication if said code comparator has removed said actuating and latched actuating signals from said transducer, and providing a second visual indication if said code comparator has not removed said actuating and latched actuating signals from said transducer.

6. An alarm for broadcasting movement of a protected article, comprising:

a motion sensing means for detecting movement of the protected article, said motion sensing means generating an actuating signal when movement is sensed;

a transducer receiving said actuating signal and thereby emitting an alert;

a container having an exterior surface, said motion sensing means and said transducer disposed within said container;

adhesive disposed on a portion of said exterior surface;

a latching circuit, said latching circuit receiving said actuating signal and thereby generating a latched actuating signal and supplying said latched actuating signal to said transducer;

a leveling circuit having an unlevel indicator, said leveling circuit receiving said actuating signal thus causing said unlevel indicator to turn on;

a disarming circuit including a code comparator for removing said actuating and latched actuating signals from said transducer; and, a status indicating circuit providing a first visual indication if said code comparator has removed said actuating and latched actuating signals from said transducer, and providing a second visual indication if said code comparator has not removed said actuating and latched actuating signals from said transducer.

7. An alarm for broadcasting movement of a protected article, comprising:

a motion sensing means for detecting movement of the protected article, said motion sensing means generating an actuating signal when movement is sensed;

a transducer receiving said actuating signal and thereby emitting an alert;

a disarming circuit, said disarming circuit including a first manually setable code generator producing a first code output manually selected from a plurality of possible code outputs, a second manually setable code generator producing a second code output manually selected from a plurality of possible code outputs, a code comparator for comparing said first code output with said second code output, said code comparator removing said actuating signal from said transducer when said first code output is the same as said second code output;

a container having an exterior surface, said motion sensing means, said transducer, said second code generator, and said code comparator disposed within said container; and, said first code generator disposed on said exterior surface of said container.

8. An alarm according to claim 7, wherein said motion sensing means includes at least one mercury switch.

9. An alarm according to claim 8, further including a first mercury switch having a first principal axis and a second mercury switch having a second principal axis, said first and second principal axes being substantially orthogonal.

10. An alarm according to claim 9, said first mercury switch having a first set of electrical leads, and said second mercury switch having a second set of electrical leads, said alarm further including a jack having a plurality of substantially orthogonally oriented electrical receptacle positions, said electrical receptacle positions suitable for accepting said first and second sets of electrical leads.

11. An alarm according to claim 7, wherein said first and second code generators include dual in-line package (DIP) switches, and said code comparator includes a plurality of exclusive NOR logic circuits.

12. An alarm according to claim 7, further including a latching circuit, said latching circuit receiving said actuating signal and thereby generating a latched actuating signal and supplying said latched actuating signal to said transducer.

13. An alarm according to claim 12, wherein said code comparator further removes said latched actuating signal from said transducer when said first code output is the same as said second code output.

14. An alarm according to claim 13, further including a status indicating circuit providing a first visual indication if said code comparator has removed said actuating and latched actuating signals from said transducer, and providing a second visual indication if said disarming circuit has not removed said actuating and latched actuating signals from said transducer.

15. An alarm according to claim 7, further including a leveling circuit having an unlevel indicator, said leveling circuit receiving said actuating signal thus causing said unlevel indicator to turn on.

16. An alarm according to claim 7, further including adhesive disposed on a portion of said exterior surface, said adhesive pressed against the protected article to mount said alarm thereon.

17. A method for broadcasting movement of a protected article, comprising the steps of:

providing an alarm comprising a motion sensing means, a transducer, a leveling circuit having an unlevel indicator, a disarming circuit including a first manually setable code generator producing a first code output and a second manually setable code generator producing a second code output;

providing a container having an exterior surface, said motion sensing means, said transducer, said leveling circuit, and said second code generator disposed within said container, and said first code generator disposed on said exterior surface of said container;

providing adhesive disposed on a portion of said exterior surface of said container;

manually setting said second code generator so as to produce a second code output selected from a plurality of possible code outputs;

manually setting said first code generator so as to produce a first code output that is the same as said first code output;

manually adjusting the orientation of said container until said motion sensing means is level and said unlevel indicator turns off;

pressing said adhesive against the article to be protected; and, arming said alarm by manually setting said first code generator so that said first code output is no longer the same as said second code output.

* * * * *